United States Patent [19]

Reschly et al.

[11] Patent Number: 5,030,054

[45] Date of Patent: Jul. 9, 1991

[54] COMBINATION MECHANICAL/PNEUMATIC COAL FEEDER

[75] Inventors: David C. Reschly, Monroe; Timothy R. Loviska, Dexter, both of Mich.

[73] Assignee: Detroit Stoker Company, Monroe, Mich.

[21] Appl. No.: 370,729

[22] Filed: Jun. 23, 1989

[51] Int. Cl.[5] ..... B65G 49/00; F23K 3/18

[52] U.S. Cl. ..... 414/174; 110/105; 406/130; 414/187; 414/195; 414/196

[58] Field of Search ..... 414/160, 172, 173, 174, 414/187, 189, 193, 195, 196, 206; 110/101 CD, 104 R, 105, 270; 406/127, 130, 131

[56] References Cited

U.S. PATENT DOCUMENTS

| | | | |
|---|---|---|---|
| 441,689 | 12/1890 | McAuley . | |
| 717,935 | 1/1903 | Shontz . | |
| 740,097 | 12/1903 | Davis . | |
| 745,247 | 11/1903 | Shontz . | |
| 755,662 | 3/1904 | Hill . | |
| 789,795 | 5/1905 | Cooke . | |
| 984,715 | 2/1911 | Swift | 414/174 |
| 1,132,715 | 3/1915 | Greenstreet . | |
| 1,173,995 | 2/1916 | Boardman . | |
| 1,211,591 | 1/1917 | Kenney et al. . | |
| 1,243,186 | 10/1917 | Kohout . | |
| 1,300,272 | 4/1919 | Jackson et al. . | |
| 1,437,342 | 11/1922 | Griggs et al. . | |
| 1,671,331 | 5/1928 | Turner et al. . | |
| 1,738,379 | 12/1929 | Lower . | |
| 1,931,181 | 10/1933 | Culver . | |
| 2,065,552 | 12/1936 | Beers . | |
| 2,075,274 | 3/1937 | Darling | 414/174 |
| 2,099,618 | 11/1937 | Olney . | |
| 2,119,010 | 5/1938 | Hogg . | |
| 2,121,313 | 6/1938 | Binney . | |
| 2,177,794 | 10/1939 | Turner . | |
| 2,198,710 | 4/1940 | Turner . | |
| 2,357,899 | 12/1944 | Kohout . | |
| 2,531,779 | 11/1950 | Midgette et al. | 414/174 |
| 2,702,726 | 2/1955 | Frendberg . | |
| 2,735,384 | 2/1956 | Kohout | 110/104 R |
| 2,829,784 | 4/1958 | Henry et al. | 414/189 X |
| 2,850,183 | 9/1983 | Blundin | 414/174 X |
| 2,894,465 | 7/1959 | Phillips | 110/270 |
| 3,167,191 | 1/1965 | Zellees, Jr. | 414/189 X |
| 3,482,534 | 12/1969 | Whitman . | |
| 4,102,278 | 7/1978 | McManama . | |
| 4,278,052 | 7/1981 | Sharp . | |
| 4,311,102 | 1/1982 | Kolze et al. . | |
| 4,326,469 | 4/1982 | Reschly . | |
| 4,434,724 | 3/1984 | Kunkel, Jr. . | |
| 4,528,917 | 7/1985 | Jacobs . | |
| 4,532,872 | 8/1985 | Anderson . | |
| 4,602,572 | 7/1986 | Giaier et al. . | |
| 4,648,329 | 3/1987 | Couarc'h et al. . | |
| 4,718,360 | 1/1988 | Giaier et al. . | |
| 4,954,034 | 9/1990 | Nelson et al. | 414/174 X |

FOREIGN PATENT DOCUMENTS

| | | | |
|---|---|---|---|
| 1091542 | 10/1960 | France | 414/195 |

*Primary Examiner*—Robert J. Spar
*Assistant Examiner*—Robert S. Katz
*Attorney, Agent, or Firm*—Harness, Dickey & Pierce

[57] ABSTRACT

A combination mechanical/pneumatic fuel feeder for feeding particulate fuel into a furnace and having a closely coupled hopper, fuel metering device, rotor and air swept delivery plate.

23 Claims, 1 Drawing Sheet

COMBINATION MECHANICAL/PNEUMATIC COAL FEEDER

BACKGROUND AND SUMMARY OF THE INVENTION

The present invention relates to a device for feeding fuel to industrial furnaces (including boilers) fired by spreader stokers, fluidized bed combustion, and like technologies, and more particularly to combination mechanical/pneumatic fuel feeders for feeding coal.

Most coal feeders in use today are of the mechanical type using a rotating shaft with blades or paddles, in that they propel the coal into the furnace. Although mechanical coal feeders work adequately, they suffer the disadvantage that they comprise many moving parts which are exposed to the heat of the furnace and often to damaging tramp material, all of which can present maintenance problems. Also, pneumatic systems such as air swept spouts have been in use for years, but principally for incineration of refuse. Typically, the metering device for such systems is remotely located with the refuse fuel free falling through a chute onto the air swept plate. Attempts have been made to mix coal with the refuse at the remote metering location and then letting the mixture free fall together, however such systems have not gained industry acceptance. Combination coal/refuse feeders have been used which consist of a mechanical coal thrower combined with an air swept refuse feeder having remote refuse metering and a free fall chute, using air of variable flow rate to spread the refuse across the furnace grate. Also, coal feeders have utilized steam or compressed air to blow coal off a shelf into a furnace, but these systems did not use a closely coupled metering conveyor, nor did they vary steam or air flow to spread the coal across the furnace to fully cover the grate with fuel. Mechanical rotors, by themselves, have a difficult time throwing very fine coal to the rear of a long furnace. By the same token, air swept feeders have difficulty in feeding coarse coal past the middle of the furnace.

One of the primary objects of the present invention therefore resides in the provision of a combination mechanical/pneumatic coal feeder which provides the pneumatic energy to propel finely sized coal particulate as well as the mechanical energy of a rotor assembly to propel coarser sized coal into the furnace. Such a combination provides improved fuel distribution within the furnace. The present invention therefore obviates the aforesaid problems and provides increased reliability and overall performance.

Other advantages and features will become apparent from the following specification taken in connection with the accompanying drawings.

DESCRIPTION OF THE PREFERRED EMBODIMENTS

Figure 1:
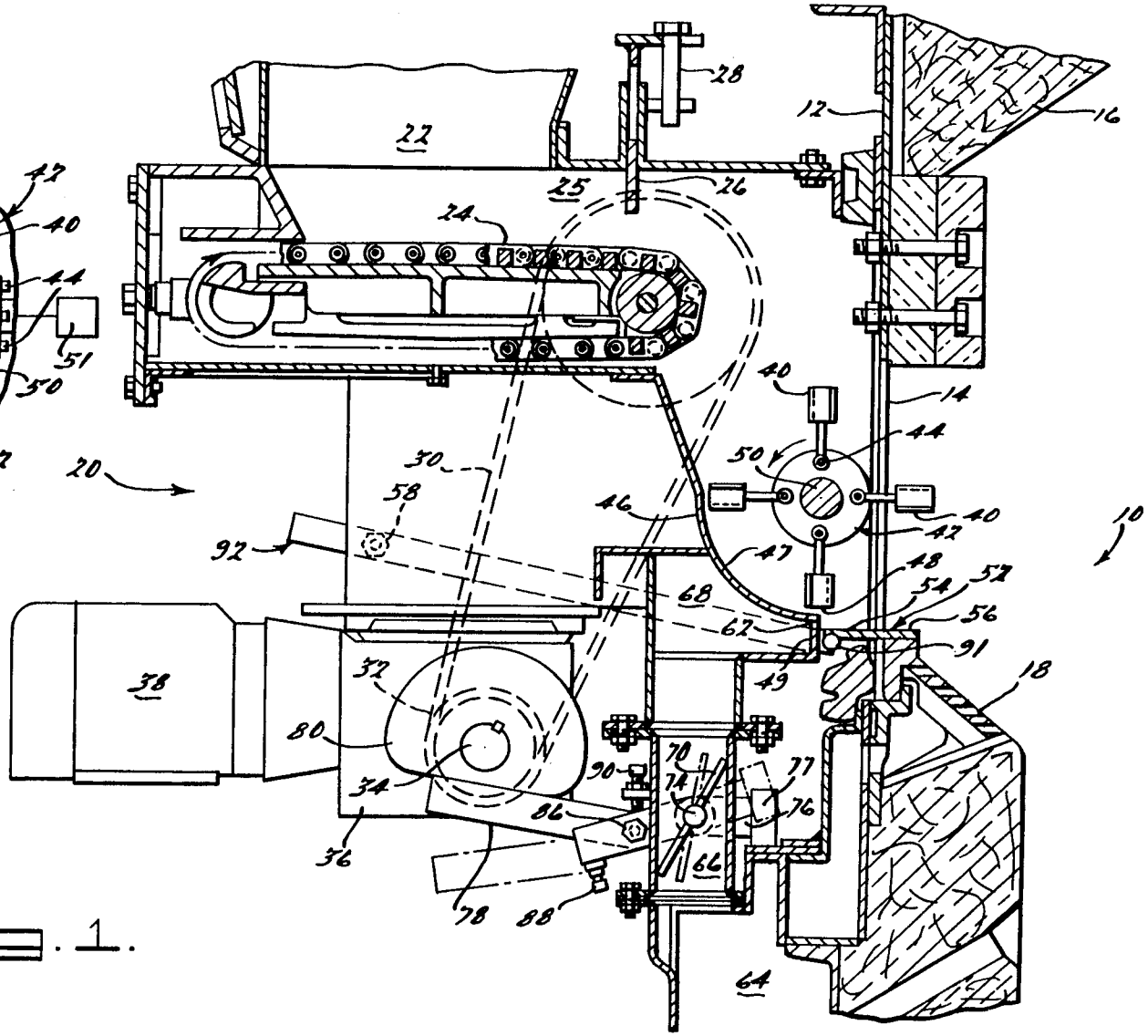
FIG. 1 is a somewhat diagrammatic vertical cross-sectional view of a combination mechanical/pneumatic coal fuel feeder according to the preferred embodiment of the present invention.
Figure 2:
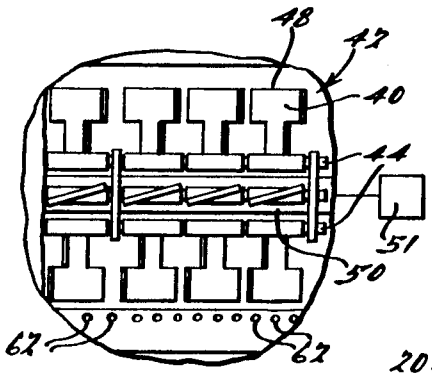
FIG. 2 is a frontal view of FIG. 1 showing the rotor assembly according to the preferred embodiment of the present invention.

Referring to FIG. 1, there is illustrated a furnace 10 having a front wall 12 in which is provided a charging opening 14. The furnace 10 is provided with the normal insulation and refractory 16, tuyeres 18, etc. and in all respects is conventional except as specifically noted.

Disposed immediately outside charging opening 14 is a combination mechanical/pneumatic feeder 20 embodying the principles of the present invention. The feeder 20 generally comprises a normally filled coal hopper 22 disposed over and opening downwardly onto a metering device in the form of a chain conveyor 24 which is driven in a clockwise direction as shown. A fuel delivery opening 25 is provided in the side of hopper 22 nearest furnace 10. Fuel delivery opening 25 is disposed adjacent to conveyor 24 with the top of conveyor 24 defining the bottom surface of opening 25. The depth of coal delivered by conveyor 24, which varies with the type and size coal being used, is controlled by a vertically movable adjustable gate 26 which is held in pre-set position within fuel delivery opening 25 and above the top surface of conveyor 24 by means of a threaded fastener 28. It is contemplated that other types of adjustable gating mechanisms could be readily adapted to the present invention. In addition, other types of metering devices may be used, such as, rotary driven or vibrating conveyor-type metering devices.

Conveyor 24 is powered by a roller chain 30 driven by a sprocket 32 on an output shaft 34 of a gearbox 36 driven by an electric motor 38. Motor 38 is preferably a variable speed motor, AC or DC, and is controlled in the usual manner by a signal from the combustion control systems (not shown) to vary the coal feed rate to satisfy the output requirements of the boiler or furnace.

Metered coal delivered by conveyor 24 drops behind blades 40 of a mechanical rotor assembly 42. Mechanical rotor assembly 42 is disposed below and immediately adjacent the end of conveyor 24 nearest furnace 10 and is arranged to receive coal therefrom. Rotor assembly 42 rotates in a counter clockwise direction, as shown. This direction of rotation is commonly referred to as "underthrow" which specifically provides for improved control of the trajectory of the coal as it is mechanically propelled into furnace 10. Underthrow propulsion alleviates disadvantages associated with clockwise rotation ("overthrow") such as the uncontrollable "spray" of coal thrown into furnace 10. Further, underthrow permits utilization of a smaller charging opening 14 to better optimize furnace efficiency and reduce heat related maintenance problems.

Rotor assembly 42 has at least one row of rotor blades 40 and preferably a plurality of four or more rows of blades 40 which are configured to splay the coal sideways in a lateral direction across the furnace grate (not shown) to provide optimum lateral distribution. Also, blades 40 which are adapted to extend at least partially into charging opening 14 of furnace 10 are pivotally secured to pivot posts 44 to inhibit jamming of oversized coal as it passes between rotor assembly 42 and rotor housing 46. Rotor housing 46 has a generally arcuate shaped surface 47 which is disposed a predetermined radial distance away from end 48 of blades 40. This radial distance is preferably adjustable, in any suitable manner, and permits finely sized coal particles to slide onto a coal delivery plate which will be detailed hereafter. Rotor housing 46 also confines the coal as it is propelled radially outwardly by the underthrow rotation of rotor assembly 42 so as to guide the trajectory of the coal into furnace 10 through charging opening 14.

Rotor assembly 42 includes a drive shaft 50 extending longitudinally in coaxial relation with blades 40. The speed of rotation of drive shaft 50 directly controls the mechanical energy generated to propel coal into furnace 10. The higher the speed of rotation, the greater the distance into furnace 10 the coal is delivered. Drive shaft 50 is driven by a variable speed motor 51 AC or DC, which is controlled utilizing a conventional electronic or mechanical controller (not shown) to selectively vary the speed of rotation. While coal can be variably distributed within the furnace based on variations in the particle coal size, the extremely wide size variability of coal as delivered does not provide optimum distribution with a constant rotor speed. Because of this, the controller will selectively vary the rotor speed above and below a mean rotational speed with the ability to selectively adjust the minimum and maximum speeds as well as the rate of change.

Coal which is not mechanically propelled by rotor assembly 42 into furnace 10 drops onto an air-swept coal delivery plate 52. Delivery plate 52 is upwardly angled and is pivotably attached to shaft 91 which can be rotated to increase or decrease the angle of inclination of delivery plate 52. A first portion 54 of delivery plate 52 is disposed immediately below the lower most edge 48 of blades 40 and a second portion 56 extends through charging opening 14. Coal delivery plate 52 provides assistance in controlling the trajectory of coal pneumatically swept into furnace 10. Coal delivery plate 52 and shaft 91 are rotatably adjustable via locking arm 92 which is held in position by fastener 58, so that delivery plate 52 can be selectively adjusted up and down to vary trajectory characteristics.

A plurality of closely spaced air jets 62 are provided on a downwardly extending surface 49 of rotor housing 46 along the lateral length thereof. Air jets 62 pneumatically propel finely sized coal particulate delivered by rotor assembly 42 onto coal delivery plate 52 into furnace 10. The air jets 62 may be similarly sized or have variable sizing depending on the requisite feeder application requirements. Air of sufficient pressure, flow rate, and volume from a remote source (not shown) is supplied to air jets 62 via an air plenum 64 which fluidly communicates through passage 66 with chamber 68 so as to directly supply air jets 62.

The pressure and volume of air supplied to chamber 68, which determines the rate of air flow through air jets 62, can be continuously varied during operation of the feeder by a valve in the form of a damper 70 disposed in passage 66, both of which extend approximately one-half to two-thirds of the width of the feeder as viewed from the front. Damper 70 is mounted on an actuating shaft 74 to which is fixed a lever 76 having at one end a follower 78 engaging a cam 80 driven by output shaft 34 and at the other end a counterweight 77 to bias follower 78 toward cam 80. Follower 78 is mounted on lever 76 by means of a fastener 86 and an adjusting screw 88 is provided on lever 76 to fine adjust the angular position of follower 78 with regard to lever 76 to properly define the extreme positions of damper 70. Second adjusting screw 90 is provided to vary the degree of oscillation of lever 76 and hence damper 70. When properly adjusted, the air being delivered to air jets 62 varies continuously between a minimum rate necessary to propel the coal on coal delivery plate 52 to the near end of the furnace grate (not shown) and a maximum rate necessary to propel the coal to the far end of the grate.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

What is claimed is:

1. A feeder for feeding particulate fuel into a furnace having a fuel charging opening, comprising:

a fuel hopper designed to be maintained substantially full of fuel and having an open lower end;

a metering device for conveying fuel in a direction toward said furnace, said metering device being disposed immediately below said open lower end of said hopper and arranged to receive fuel therefrom;

a fuel delivery opening associated with said open lower end of said hopper, said fuel delivery opening being disposed immediately adjacent said metering device with the top of said metering device defining the bottom of said opening;

a rotor disposed below and immediately adjacent the end of said metering device closest to said furnace and positioned to receive fuel delivered by said metering device, said rotor having at least one row of blades extending into said charging opening and rotating at the outermost edge thereof in a direction toward said metering device to mechanically propel large particles of said fuel into said furnace;

a rotor housing adjacent said rotor and having an arcuate portion with a first and second end, said first end adjacent said metering device and said second end disposed below said rotor;

an adjustable means associated with said fuel delivery opening for metering the quantity of fuel delivered by said metering device to said rotor;

means associated with said rotor for metering the quantity of fuel delivered by said rotor to said furnace;

speed control means for variably controlling the speed of rotation of said rotor so that fuel is mechanically propelled into said furnace over a range of distances;

a generally horizontally disposed plate having a first portion disposed substantially below said rotor and said second end of said arcuate portion and adjacent thereto and positioned to receive finely sized particles of fuel delivered therefrom, and a second portion extending into said charging opening;

at least one air jet disposed above and adjacent said first portion of said plate and below and adjacent said second end of said arcuate portion, said air jet positioned to direct air along the top surface of said plate against fuel delivered to said plate by said rotor to pneumatically propel said finely sized particles of fuel across said plate into said furnace; and flow control means for supplying air at a varying flow rate to said air jet so that the finely sized particles of fuel are propelled into said furnace over a range of distances.

2. A feeder according to claim 1 wherein said flow control means comprises a valve having an actuating shaft and being disposed in an air supply passage, and powered actuating means connected to said shaft for causing said valve to oscillate between a relatively open position and a relatively closed position when said feeder is operating.

3. A feeder according to claim 2 wherein said powered actuating means comprises a lever arm affixed to said shaft, a powered cam engaging said arm to cause it to oscillate and a counterweight on said arm to cause said arm to be biased towards said cam.

4. A feeder according to claim 3 wherein said metering device and cam are drivingly interconnected.

5. A feeder according to claim 3 further comprising adjustable limit means for limiting the maximum amplitude of oscillation of said lever arm.

6. A feeder according to claim 3 further comprising means for adjusting the open and closed angular positions of said valve relative to said passage.

7. A feeder according to claim 1 wherein said metering device is a generally horizontally disposed conveyor.

8. A feeder according to claim 7 wherein said adjustable means is a gate which controls the depth of fuel delivered by said conveyor through said furnace delivery opening.

9. A feeder according to claim 1 wherein said air jet comprises a plurality of bores extending across the lateral length of said plate.

10. A feeder according to claim 1 further comprising means for adjusting the position of said plate relative to the lower end of said rotor.

11. A feeder according to claim 1 wherein said speed control means is a drive shaft coupled to said rotor such that the speed of rotation of said drive shaft is variably controlled by a remote controller device.

12. A feeder according to claim 1 further comprising pivotal means associated with said rotor blades for inhibiting jamming of fuel between said rotor blades and said rotor housing.

13. A feeder according to claim 1 further comprising angular adjustment means associated with said plate for selectively adjusting the angle of inclination of said plate relative to said air jet.

14. A feeder according to claim 13 wherein said angular adjustment means comprises a generally horizontally extending pivotable shaft coupled to said plate, said shaft rotatably coupled to a locking arm for selectively rotating said shaft and plate.

15. A combination mechanical and pneumatic feeder for feeding particulate fuel into a furnace having a fuel charging opening, comprising:

a fuel hopper having an open lower end;

a metering device for conveying fuel in a direction toward said furnace, said metering device disposed immediately adjacent said hopper and positioned to receive fuel therefrom;

a rotor disposed below and immediately adjacent the end of said metering device closest to said furnace and positioned to receive fuel delivered by said metering device, said rotor having at least one row of blades extending into said charging opening and rotating at the outermost edge thereof in a direction toward said metering device to mechanically propel large particles of said fuel into said furnace;

a rotor housing adjacent said rotor and having an arcuate portion with a first and second end, said first end adjacent said metering device and said second end disposed below said rotor;

a generally horizontally disposed, delivery plate having a first portion disposed substantially below said rotor and said second end of said arcuate portion and adjacent thereto and arranged to receive finely sized particles of fuel delivered therefrom, and a second portion extending through said charging opening; and at least one air jet disposed above and adjacent said first portion of said plate and below and adjacent said second end of said arcuate portion, said air jet positioned to direct air along a top surface of said plate against fuel delivered to said plate by said rotor to pneumatically propel said finely sized particles of fuel across said plate into said furnace.

16. A feeder according to claim 15 further comprising flow control means for supplying air at a continuously varying flow rate to said air jet so that fuel is pneumatically propelled into said furnace over a range of distances.

17. A feeder according to claim 16 further comprising means for adjusting said flow control means for changing the maximum and minimum values of said varying flow rate.

18. A feeder according to claim 15 wherein said metering device includes a generally horizontal conveyor.

19. A feeder according to claim 18 wherein said metering device includes a gate for controlling the depth of fuel delivered by said conveyor.

20. A feeder according to claim 15 further comprising speed control means for variably controlling the speed of rotation of said rotary means.

21. A feeder according to claim 15 wherein said fuel is coal of a particulate size ranging from fines to about a $1\frac{1}{4}''$ cross section, said rotor mechanically propels said larger sized coal into said furnace over a range of distances while said air jet pneumatically propels said finely sized coal into said furnace over a range of distances to provide a uniform mix therein.

22. A feeder according to claim 15 wherein said air jet comprises a series of bores extending across a lateral length of said delivery plate.

23. A feeder according to claim 22 further comprising angular adjustment means for selectively adjusting the angular inclination of said delivery plate relative to said air jets.

* * * * *

UNITED STATES PATENT AND TRADEMARK OFFICE

CERTIFICATE OF CORRECTION

PATENT NO. : 5,030,054

DATED : July 9, 1991

INVENTOR(S) : David C. Reschly et al

It is certified that error appears in the above-identified patent and that said Letters Patent is hereby corrected as shown below:

On the title page, under "U.S. Patent Documents", reference to Cooke:

"789,795" should be -- 789,796 --.

Signed and Sealed this

Thirteenth Day of April, 1993

*Attest:*

STEPHEN G. KUNIN

*Attesting Officer*

*Acting Commissioner of Patents and Trademarks*